US006872315B2

(12) United States Patent
Effenhauser et al.

(10) Patent No.: US 6,872,315 B2
(45) Date of Patent: Mar. 29, 2005

(54) PUMP FOR LOW FLOW RATES

(75) Inventors: Carlo Effenhauser, Weinheim (DE); Herbert Harttig, Altrip (DE); Peter Kraemer, Deidesheim (DE)

(73) Assignee: Roche Diagnostics Corporation, Indianapolis, IN (US)

( * ) Notice: Subject to any disclaimer, the term of this patent is extended or adjusted under 35 U.S.C. 154(b) by 0 days.

(21) Appl. No.: 10/912,705

(22) Filed: Aug. 5, 2004

(65) Prior Publication Data

US 2005/0006309 A1 Jan. 13, 2005

Related U.S. Application Data

(62) Division of application No. 09/884,879, filed on Jun. 19, 2001.

(30) Foreign Application Priority Data

Jun. 21, 2000 (DE) ..... 100 29 453

(51) Int. Cl.[7] ..... B01D 29/00

(52) U.S. Cl. ..... 210/640; 210/321.72; 95/45; 96/4; 600/347

(58) Field of Search ..... 210/640, 321.72, 210/321.9, 266, 502.1, 321.6; 96/4; 95/45; 600/347

(56) References Cited

U.S. PATENT DOCUMENTS 4,636,307 A * 1/1987 Inoue et al. ..... 210/188
4,832,034 A 5/1989 Pizziconi et al. ..... 128/632
4,976,866 A * 12/1990 Grinstead et al. ..... 210/638
5,045,202 A * 9/1991 Stearns et al. ..... 210/628
5,045,207 A 9/1991 Fecondini et al. ..... 210/645
5,552,046 A * 9/1996 Johnston et al. ..... 210/266
5,693,230 A * 12/1997 Asher ..... 210/650
5,938,928 A 8/1999 Michaels ..... 210/634
6,039,792 A 3/2000 Calamur et al. ..... 95/45
6,136,189 A * 10/2000 Smith et al. ..... 210/266
6,660,165 B1 * 12/2003 Hirabayashi et al. ..... 210/640

FOREIGN PATENT DOCUMENTS

EP 0 722 288 B1 7/1997
GB 2 208 324 A 3/1989
WO WO 95/10221 4/1995

OTHER PUBLICATIONS

Stanley Abramowitz, "DNA Analysis in Microfabricated Formats" Journal of Biomedical Microdevices 1:2, 107–112, 1999, 1999 Kluwer Publishers.

* cited by examiner

*Primary Examiner*—Ana Fortuna
(74) *Attorney, Agent, or Firm*—Jill L. Woodburn

(57) ABSTRACT

The present invention concerns a method of producing flow rates of a transport liquid of about 1 to 1000 nl/min. The method provides a pump having a housing defining a space and including a channel and a wettable membrane positioned in the housing, the membrane including a first side facing toward the channel and a second side facing the space. The method further includes at least partially filling the channel with the transport liquid, contacting the wettable membrane with the transport liquid to generate an underpressure in the channel,evaporating the transport liquid at the wettable membrane to remove the transport liquid from the channel and to create an underpressure in the channel, and maintaining a generally constant vapor pressure of the transport liquid in the space.

5 Claims, 6 Drawing Sheets

Fig. 2
Fig. 2A
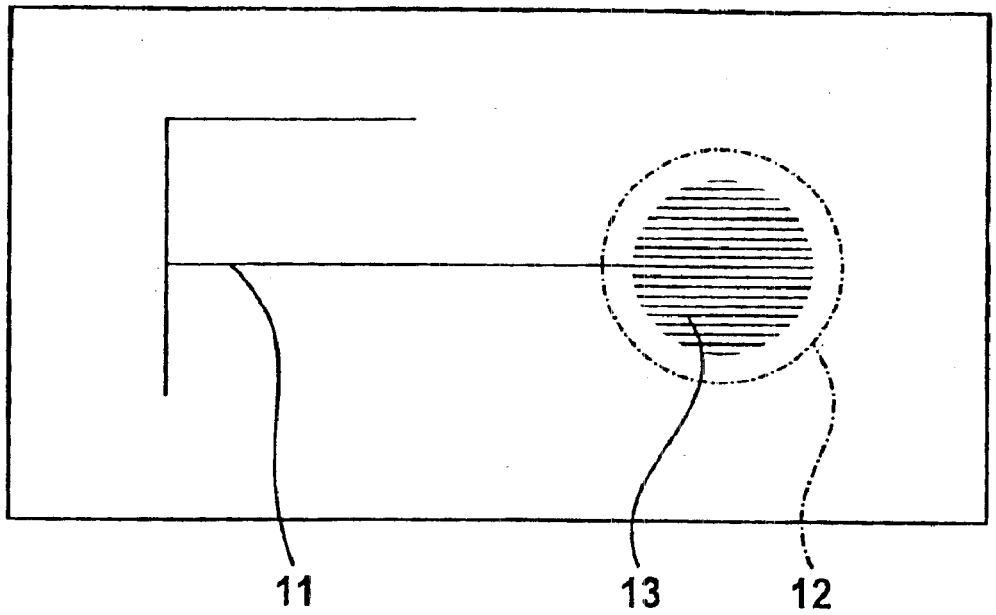
Fig. 2B
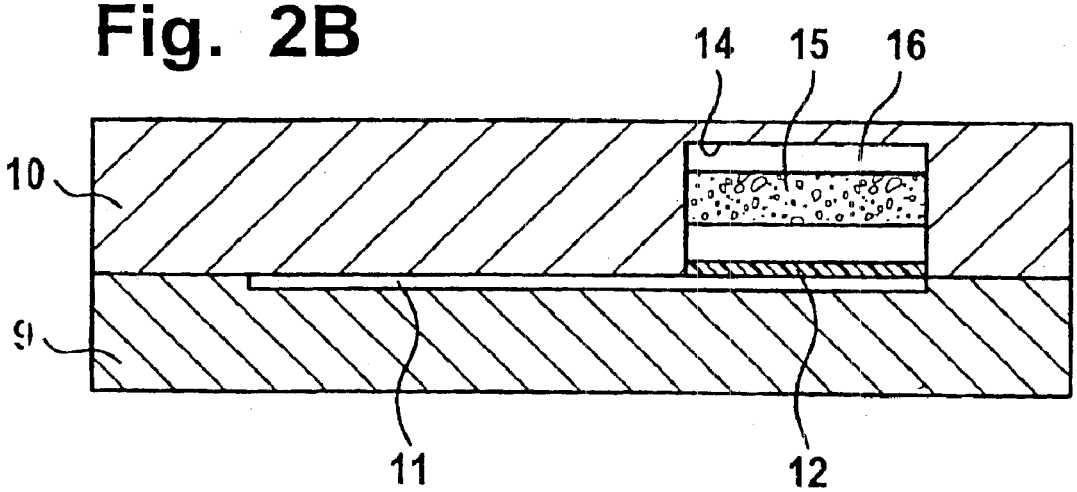

PUMP FOR LOW FLOW RATES

CROSS-REFERENCE TO RELATED APPLICATIONS

The present application is a divisional of U.S. patent application Ser. No. 09/884,879, filed on Jun. 19, 2001, which claims priority to DE 100 29 453.7 filed on Jun. 21, 2000.

BACKGROUND AND SUMMARY OF THE INVENTION

The present invention concerns a pump for flow rates in the range from about 1 to 1000 nl/min. The pumps according to the invention are particularly suitable for applications in the field of medical diagnostics such as microdialysis or ultrafiltration.

A pump is claimed for low flow rates which having channel which is at least partially filled with a transport liquid and a membrane that can be wetted by the transport liquid which closes one opening of the channel and through which evaporation can take place. There is a space on the opposite side of the membrane to the transport liquid which has an essentially constant vapour pressure of the transport liquid. The invention also encompasses microdialysis and ultrafiltration systems containing such a pump.

Miniaturized pumps are known in the prior art e.g. peristaltic pumps which can achieve flow rates as low as about 100 nl/min. The focus of miniaturized pump development is usually to achieve the highest possible delivery rate with a minimum pump volume. Furthermore it has turned out that such pumps do not operate reliably enough in the low pumping range when used for long-term applications and in particular it is difficult to avoid large variations in the flow rates. Other arrangements are known in the field of ultrafiltration and microdialysis in which a negative pressure reservoir (for example a drawn syringe) is connected to a fluid system via a constricted capillary path. However, this has the disadvantage that the pressure time course is non-linear. A further arrangement for achieving low flow rates is known from the document WO 95/10221.

In this arrangement a liquid located in a channel is directly contacted with a sorbent. Typical flow rates for such a system are in the range of a few $\mu$l/min. The long-term constancy (measured over several days) of this pump is quite low.

The object of the present invention was to provide a pump for very low flow rates which operates reliably and has a sufficiently constant flow rate over a long time period (e.g. several days). A further object of the present invention was to propose a pump for such low flow rates which is very simple and cost-effective to manufacture. The pump should also be mechanically simple to manufacture and be compatible with integrated microfluidic systems based on planar technologies (e.g. microtechnology).

With a pump according to the invention a transport liquid is located in a channel which has an opening which is closed by a membrane that can be wetted by the transport liquid. Transport liquid penetrates the membrane due to capillary effects and is led away via capillary channels through the membrane into a gas space having an essentially constant vapour pressure of the transport liquid or it is physically or chemically bound (taken up) by a suitable sorbent such that further unhindered evaporation through the membrane can occur. The constant vapour pressure conditions in the gas space result in a constant flow rate.

Within the scope of the invention it is possible to generally use transport liquids which can penetrate into a membrane and evaporate through it. Aqueous transport liquids are preferred within the scope of the present invention. In addition to the water component, aqueous transport liquids can contain substances or mixtures which influence the surface tension and/or the viscosity in order to adjust the permeation properties of the transport liquid into the membrane to a desired value. However, the transport liquids preferably contain no substances that cannot evaporate at room temperature, e.g. salts, since these could lead to a blockage of the membrane. Suitable embodiments are described further below for cases in which it is intended to transport liquids containing substances that cannot evaporate.

The channel of the pump according to the invention preferably has an area in the range 1 to $10^5$ $\mu m^2$ and a length of 1–1000 mm. The lateral dimension of the cross section is preferably greatly enlarged (1 to 1000 $mm^2$) in the area of the wettable membrane in order to provide an adequately large exchange area with the adjoining gas space. The evaporation process at the membrane removes transport liquid from the fluid channel and thus generates an underpressure which causes the desired pump action. The pump can be used to transport the transport liquid itself when for example this liquid is used as a perfusion liquid for a microdialysis. In another inventive embodiment the fluid channel contains a working fluid which for example is used as a perfusate or for other purposes and is segmented from the transport liquid. In another application of the pump such as ultrafiltration, evaporation of the transport liquid generates an underpressure in the channel which conveys a fluid from the surroundings into the fluid channel. In the field of ultrafiltration this would be an external fluid (interstitial fluid) which enters the channel through an ultrafiltration membrane.

The term membrane in the sense of the present invention is intended to generally encompass structures through which liquid is sucked from the fluid channel by capillary forces and evaporated. In addition to the bodies that are referred to as membranes in everyday usage which have a plurality of usually disordered capillary channels, the term membrane is also intended to encompass arrays of (possibly only a few) capillary channels. Such an embodiment is described in more detail in conjunction with the figures. Such capillary arrays can be manufactured by microtechnical methods in which very small and constant cross-sections are achievable. Very low flow rates can be achieved with such capillary-active membranes that can be adjusted by the manufacturing process via the number and cross-section of the capillary channels.

The evaporation rate can be additionally controlled by sealing with a hydrophobic, non-wettable membrane (e.g. Teflon).

In cases were either a direct contact of the liquid to be transported with the evaporator membrane has to be avoided e.g. when transporting liquids containing salts where direct evaporation on the membrane would lead to the formation of a solid salt residue with a concomitant damaging effect on the constancy of the evaporation rate, or when for example a suitable sorbent is not available for the liquid to be transported, the indirect approach of using an additional transport liquid (for example degassed and deionized water) can ensure the pump operation.

In the case of immiscible liquids (e.g. toluene as the liquid (working fluid) to be transported, water as the evaporating transport liquid), it is possible for the two liquids to be present directly in the system with a common phase boundary without the liquid to be transported coming into contact with the membrane during pump operation over a long period (e.g. for several days). This can be achieved by using a stock of transport liquid in an intermediate buffer which is preferably larger than the total volume of transport liquid (working fluid) to be conveyed.

In the case of miscible liquids the two liquids (e.g. Ringer's solution and pure water) can be segmented from one another by an impermeable membrane. In this case a diffusion barrier can also be preferably used such that in the above case the Ringer's solution displaces a water volume located in one or several connected reservoirs (e.g. a dilution cascade) and the concomitant dilution ensures that the salt concentration at the evaporation membrane is reduced to an adequate extent. This can prevent or at least reduce salting-out on the membrane which would otherwise alter the pump rate. The advantages of this solution are that it avoids moving parts (e.g. a bending membrane), and is simple to manufacture and integrate into the pump body.

A further advantage of this solution is that, depending on the geometric design of the transport path, the reservoirs can act wholly or partially as bubble traps for gases that may be present in the liquid to be transported or which may be released during transport and thus can help to prevent direct contact of gas bubbles with the evaporation membrane.

Another simple method for segmenting the liquid to be transported and the transport liquid is to introduce a gas bubble which permanently separates the t0o liquids. The volume of this gas bubble must be large enough to guarantee segmentation over all changes in the cross-section of the transport path and optionally also in the container which serves as a storage medium for the transport liquid.

An advantage of the solution employing one or several reservoirs to dilute the liquid to be transported compared to a gas bubble for segmentation is that the function is still ensured even after strong shaking movements which in the case of gas bubble segmentation could lead to a mixing of the liquids. The fact that the gas bubble may dissolve in the liquid shows that it also has the disadvantage that the flow rate additionally depends on temperature due to the temperature-dependent expansion/contraction of the gas buffer.

An important aspect of the present invention is the membrane that can be wetted by the transport liquid. The pump effect of the membrane is based on the fact that a liquid can be sucked by surface forces into capillaries or pores of the membrane. The capillary pressure that is generated by this means is directly proportional to the surface tension of the liquid and to the cosine of the angle of contact between the liquid and the membrane material and is inversely proportional to the radius of the capillaries or pores. Hence membranes are suitable for the present invention which have a contact angle with regard to the transport liquid between 0 and 90 degrees. This stated relationship also shows that the capillary pressure increases when the diameter of the capillaries or pores decreases. Typical pore diameters of capillaries in the membrane are in the range from 10 nm to 100 $\mu$m. It is important for the present invention that the transport liquid is in direct contact with the membrane such that a capillary effect occurs. Consequently it is necessary to ensure that there is no interruption in the liquid contact between the transport liquid and membrane which may occur when the pore diameter of the membrane becomes too large with a concomitant decrease in capillary pressure or it may also be caused by a defect (hole) in the membrane which would lead to a pressure equilibration by the return flow of gas.

Furthermore it is advantageous to use membrane systems within the scope of the invention which, apart from a wettable membrane, have an additional membrane which is located on the side of the first membrane which faces away from the transport liquid. Membranes which cannot be penetrated by liquids with a high surface tension can be used for this second membrane such as membranes made of PTFE, Cuprophan® or Gambran®. The evaporation rate of the transport liquid can be modulated by means of the properties of this second membrane. Furthermore it is also possible to use membranes which have different regions of which one region facing the transport liquid is wettable and a region facing away is not wettable.

It is also possible to integrate the manufacture of the pump body and membrane (monolithic) or to use tailor-made membranes of a defined pore size and pore distribution in a hybrid approach. The integrated manufacture of such membranes based on silicon is described for example in T. A. Desai et al., Biomedical Microdevices 2 (1999), 11–41. Another method is to use a microporous Si membrane having a statistical distribution of pore sizes (R. W. Tjerkstra et al., Micro Total Analysor Systems 1998, Kluwer 1998, p. 133–136). Such membranes can for example be manufactured in polymer substrates using laser ablation, hot-stamping etc.

The pump action of the membrane used is maintained until the partial pressure of the liquid to be pumped on the side of the membrane facing away from the liquid (gas side) is less than the saturation vapour pressure at the respective working temperature. In order to maintain a constant vapour pressure (and to minimize possible environmental influences) it is proposed that a gas space be provided which contains a sorbent which is not in direct contact with the wettable membrane. The continuous sorption of the evaporating liquid maintains a constant difference of the vapour pressure over the liquid in the pores and the saturation vapour pressure.

The term sorbent encompasses adsorbents as well as absorbents. Suitable sorbents are for example silica gels, molecular sieves, aluminium oxides, zeolites, clays, active charcoal, sodium sulfate, phosphorous pentoxide etc.

It is important for the desired pump function that there is no direct contact between the sorbent and the capillaries/pores of the wettable membrane to prevent direct transfer of liquid by this means. On the contrary, in order to achieve low flow rates that remain constant over long periods it is necessary that firstly evaporation of transport liquid occurs and that the evaporated transport liquid is taken up from the gas phase by the sorbent. This can be achieved by spacing apart the wettable membrane and the sorbent such that there is no direct fluid contact. Furthermore it is possible to use one (or also several) non-wettable membrane(s) which are preferably located directly next to the wettable membrane. With such a membrane the sorbent can also be in direct contact without generating a fluid short circuit. Such an arrangement also enables the use of a liquid sorbent such as a highly concentrated or saturated salt solution. Another method is to modify a region of the wettable membrane that faces away from the transport liquids or faces the sorbent in such a manner that the membrane cannot be wetted and thus adopts the function of a second non-wettable membrane. Such a modification of the membrane can for example be achieved by a plasma reaction. With embodiments containing membranes which have a wettable region and a non-wettable region, the sorbent can directly contact the non-wettable region without making a fluid short-circuit.

In order to be effective the sorbent should be located in a vessel (container) which seals it from the outer space and in particular largely prevents penetration of moisture from the external space. The vessel has an opening which is closed by the wettable membrane or the non-wettable membrane. As a result evaporated transport fluid enters the vessel through the membrane and is taken up there by the sorbent. The sorbent should be selected such that the equilibrium vapour pressure of the transport liquid which is less than the saturation vapour pressure of the fluid in the gas phase remains constant for a long period as a result of the sorbent. This is important in order to set a defined evaporation rate of the transport liquid which increases the constancy of the flow rate.

It was surprisingly found that embodiments of the vessel containing the sorbent having flexible walls did not have an adverse effect on the pump action but on the contrary variations in the flow caused by pressure changes in the external space or by temperature changes were considerably reduced. Foils such as 3E composite aluminium foils of low density and low buckling strength are especially suitable as flexible walls. Elastic plastics such as silicons can also be used.

It was surprisingly found that another simplified embodiment which does not need any sorbent also results in very constant transport rates. In this embodiment a space is enclosed by walls to form a housing above the side of the membrane or of the membrane sandwich which faces away from the transport liquid, the walls having openings which comprise between 0.001% and 100% of the surface of the walls i.e. the housing is omitted in the extreme case. The transport rate of liquid vapour into the surrounding gas phase can be adjusted over a wide range by the geometric dimensions and number of openings and by the choice of gas permeable membranes. Embodiments are also possible in which the space on the side of the membrane opposite to the transport liquid is not surrounded by a housing belonging to the pump. This is the case when the space per se has an essentially constant vapour pressure of the transport liquid which is the case for air-conditioned rooms. In □articular designs are also possible in which the pump according to the invention is used within an air-conditioned system for example an analyser.

The transport rate depends on a number of factors of which the viscosity of the liquid and the membrane properties have already been mentioned above. These influencing variables in turn depend on the temperature. Hence, for example the evaporation rate and also the diffusion rate in the gas phase increase with increasing temperature. In contrast a temperature increase has the opposite effect on the viscosity of the liquid, the surface tension of the liquid and the interfacial tension between the membrane and liquid. Hence there is a complex relationship between the transport rate and the temperature. However, a low temperature dependency can be ensured by suitable selection of the relevant materials such as the membrane(s) and the sorbent. The present invention is particularly suitable for applications under thermostatted conditions. On the one hand it is possible to have an active temperature control where for example the temperature in the region surrounding the membrane is adjusted to a preselected range using a peltier element. A pump according to the invention can be used particularly advantageously in close contact with the human body. In this case direct contact of the housing in which the pump is located with the body surface is advantageous. The temperature regulation can be additionally supported by thermally insulating the sides of the pump or microdialysis or ultrafiltration system that are not adjacent to the body. In addition it is also possible to integrate a temperature measuring unit into a system containing a pump according to the invention which reports deviations from a target temperature range or even takes into account the currently measured temperature when evaluating analytical measurements.

There is preferably no direct contact between the transport fluid and the wettable membrane when the pump according to the invention is delivered to avoid an unnecessary consumption of liquid. When the pump is put into operation by the user the contact can be made by applying a pressure pulse to a certain area.

The liquid pumps according to the invention enable the very advantageous construction of microdialysis and ultrafiltration systems. In the case of microdialysis the transport liquid can be used directly as the perfusate which is led through a microdialysis catheter in order to take up the analyte. Alternatively □t is also possible to have a liquid (e.g. Ringer's solution) which is different from the transport liquid which is fluidically coupled to the transport liquid.

In the case of ultrafiltration the consumption of transport liquid by the evaporation process can be used to generate an underpressure in the channel which draws in body fluid (interstitial fluid) into an ultrafiltration catheter. In the case of microdialysis as well as ultrafiltration a sensor may be provided downstream of the microdialysis membrane or ultrafiltration membrane for the detection of one or several analytes.

BRIEF DESCRIPTION OF THE DRAWINGS

The present invention is elucidated in more detail by figures.

FIG. 2: Top-view and cross-section through a pump according to a second embodiment

DETAILED DESCRIPTION OF THE INVENTION

Figure 1:
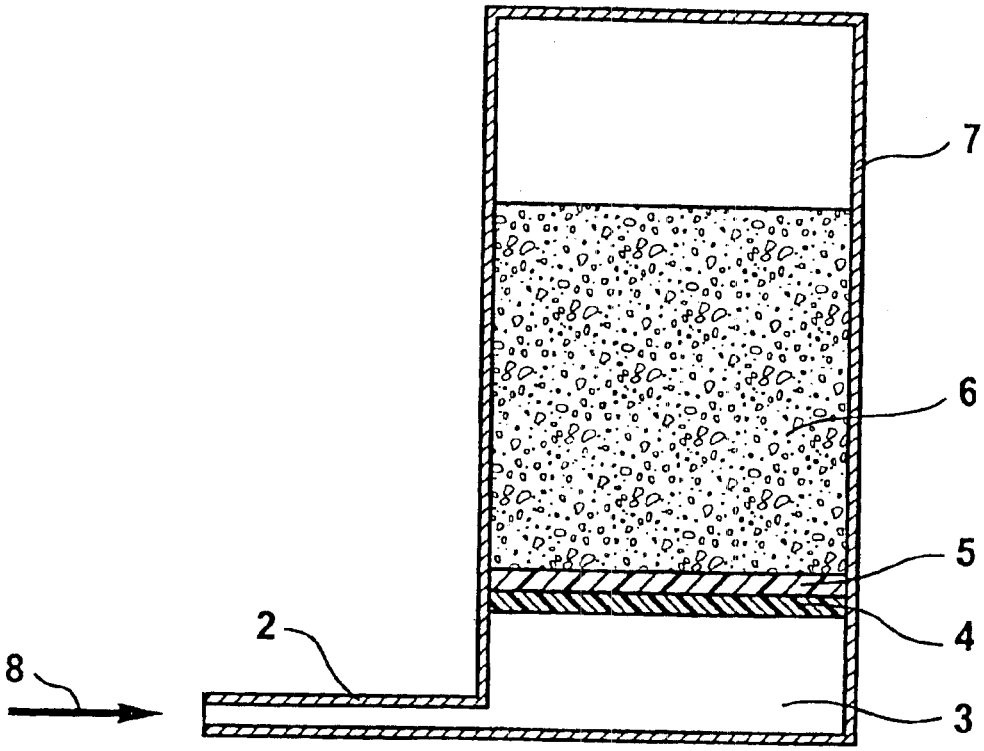
FIG. 1: Cross-section through a first embodiment of a pump containing sorbent

FIG. 1 shows a cross-section through a pump according to a first embodiment. The arrangement shown has a channel (2) having a diameter of 100 $\mu$m in which a transport liquid is located. Water was chosen as the transport liquid in the case shown. The channel is closed with a wettable membrane (4) in a region of the transport channel with an enlarged cross-section. In the present case a BTS 65 from the Memtec Company (now: USF Filtration and Separations Group, San Diego, Calif., USA) (PESu hydrophilized with hydroxypropyl cellulose) was used as the membrane. This very hydrophilic membrane is asymmetric and has pores in the range from about 10 $\mu$m on one side and 0.1 $\mu$m on the other side. The side with the larger pores faces the liquid. A non-wettable membrane made of expanded PTFE is located above the wettable membrane (4). The non-wettable membrane is mounted on the wettable membrane in such a manner that it completely covers the side of the wettable membrane (4) which faces away from the transport liquid (3). The figure shows that the arrangement was selected such that the transport liquid can only evaporate from the channel system via the wettable membrane (4). The system comprising the wettable (4) and non-wettable membrane (5) is surrounded by a housing (7) in such a manner that evaporated transport liquid can only reach the interior of the housing or vessel (7). The interior of the housing (7) contains a sorbent (6) which is silica gel in the present example (molecular sieve MS 518, Grace Favison, Baltimore, Md., USA). FIG. 1 also shows that the sorbent is in direct contact with the non-wettable membrane. As described above this is possible because the non-wettable membrane prevents a fluid short-circuit i.e. a direct sorbtion of liquid from the capillaries of the wettable membrane without a gaseous vaporous intermediate phase. The pump shown achieved in experiments a flow rate in the range of 1 to 1000 nl/min (nanolitres per minute) in the direction of the arrow (8).

FIG. 2 shows a system which is technically very advantageous to manufacture and to miniaturize. The pump of FIG. 2 has a base plate (9) with depressions which form a capillary system (11) in conjunction with a cover (10). FIG. 2*b* shows how the base plate and cover are arranged relative to one another. A wettable membrane (12) is disposed above a channel system (13) and is located between these two units. The membrane can be attached by simply clamping it between the base plate and cover. The cover and base plate can for example be joined together by glueing, pressing or ultrasonic welding. The channel system (13) can be simply formed by a recess in the base plate in which additional cross-pieces are located to prevent the membrane from sagging. In this manner capillary channels are formed by interaction with the underside of the membrane which ensure that the channel system is completely filled with transport liquid. Such a channel system enlarges the surface from which transport liquid passes into the wettable membrane. FIG. 2*b* additionally shows that the cover has a recess (14) which is located above the membrane (12). The relative arrangement of the channel, membrane and vessel for taking up evaporated transport liquid ensures that transport liquid can only escape into the recess (14). The recess (14) which forms the vessel contains a sorbent (15) which absorbs transport liquid located in the gas space (16). The embodiment shown in FIG. 2 only requires a single wettable membrane (12). A non-wettable membrane can be omitted since the membrane and sorbent are spaced apart and can only exchange via the gas space.

Figure 3:
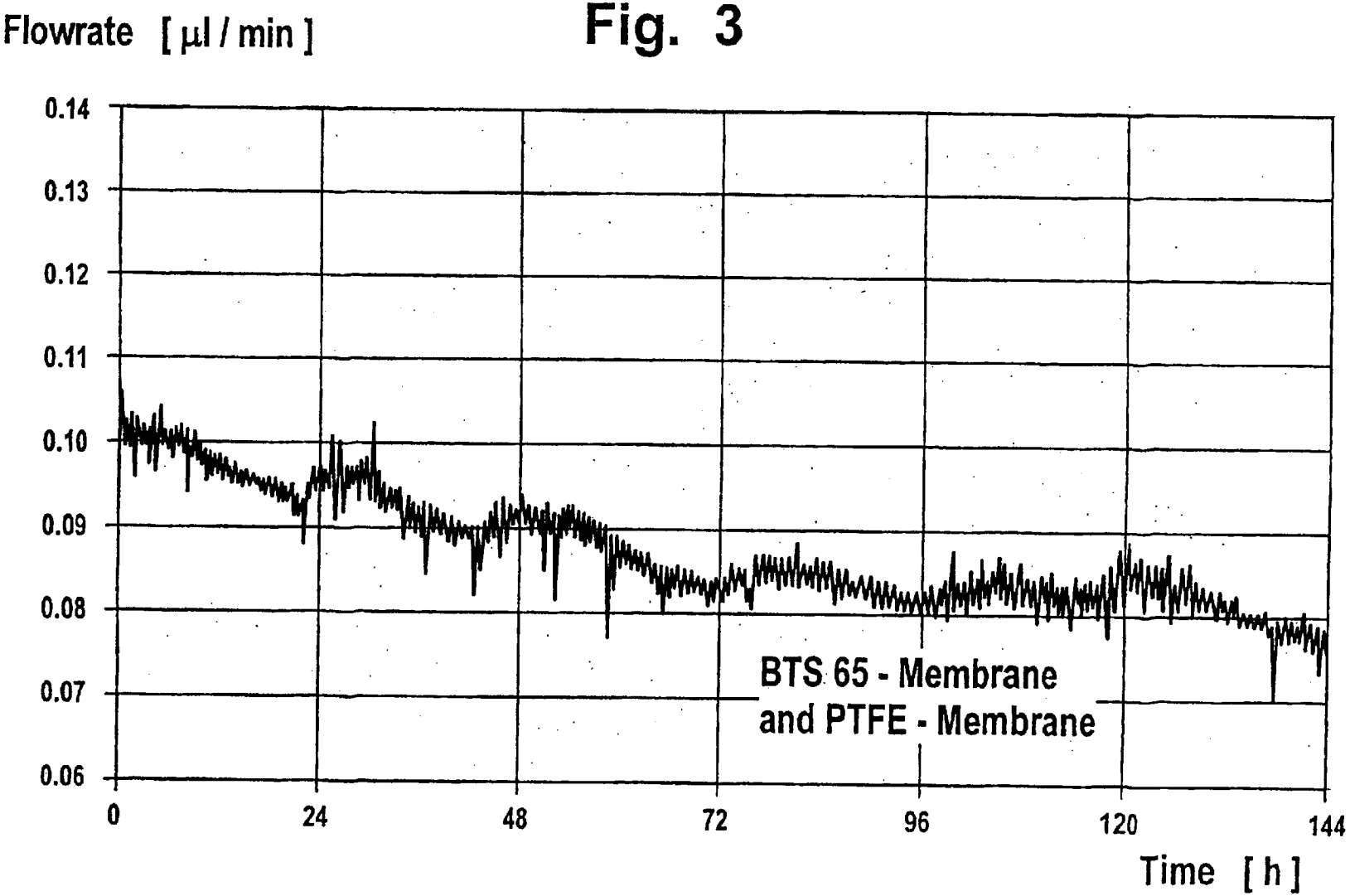
FIG. 3: Flow rate of a pump according to FIG. 1

FIG. 3 shows a measurement of flow rates which were achieved with an apparatus according to FIG. 1 over a period of 6 days. The flow rate was measured by gravimetric determination of the decrease of liquid in the storage container. The pump which gave the results shown in FIG. 3 had a circular exchange surface of the transport liquid with the membrane (diameter 2 mm). A hydrophilic membrane named BTS 65 (see the above description) and a non-wettable polytetrafluoroethylene membrane as an evaporation limiter were used. 8 g silica gel was used as the sorbent for the transport liquid (water). Apart from the enlarged section of the channel below the membrane, the channel had a diameter of 100 $\mu$m and a length of 40 cm. FIG. 3 shows that the flow rate only decreased from 100 nl/min to about 80 nl/min during the period of 6 days. Such a change in flow rate can be tolerated for applications in the field of microdialysis and ultrafiltration since they do not significantly effect the analytical result.

Figure 4:
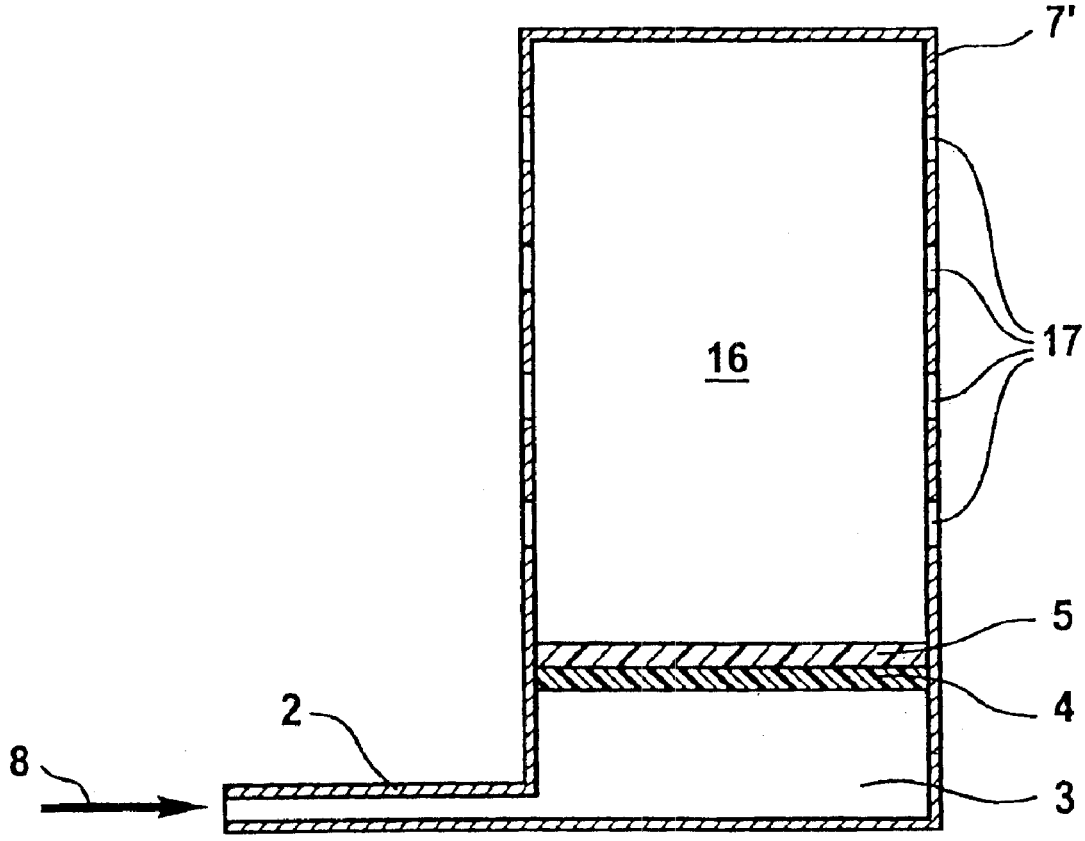
FIG. 4: Cross-section through a pump without sorbent

FIG. 4 shows a pump according to the invention without a sorbent. The dimensions as well as the wettable (4) and non-wettable membrane (5) of this pump correspond to that shown in FIG. 1. A housing (7') is located above the non-wettable membrane and is arranged such that transport liquid (3) can only evaporate into the space (16) of this housing. The housing (7') differs from the housing shown in FIG. 1 in that it has openings (17) through which the evaporated transport liquid can escape from the space (16). Membranes can be provided instead of openings which allow diffusion of gaseous transport liquid. Thus it is for example possible to make the housing completely of a material that allows adequate diffusion and has no openings. The said embodiments achieve a diffusion equilibrium between the inner space (16) and the surroundings which ensures that the vapour pressure of the transport liquid in the interior space (16) is essentially constant. Hence an essentially constant evaporation rate and thus also transport rate is achieved in the channel (2).

Figure 5:
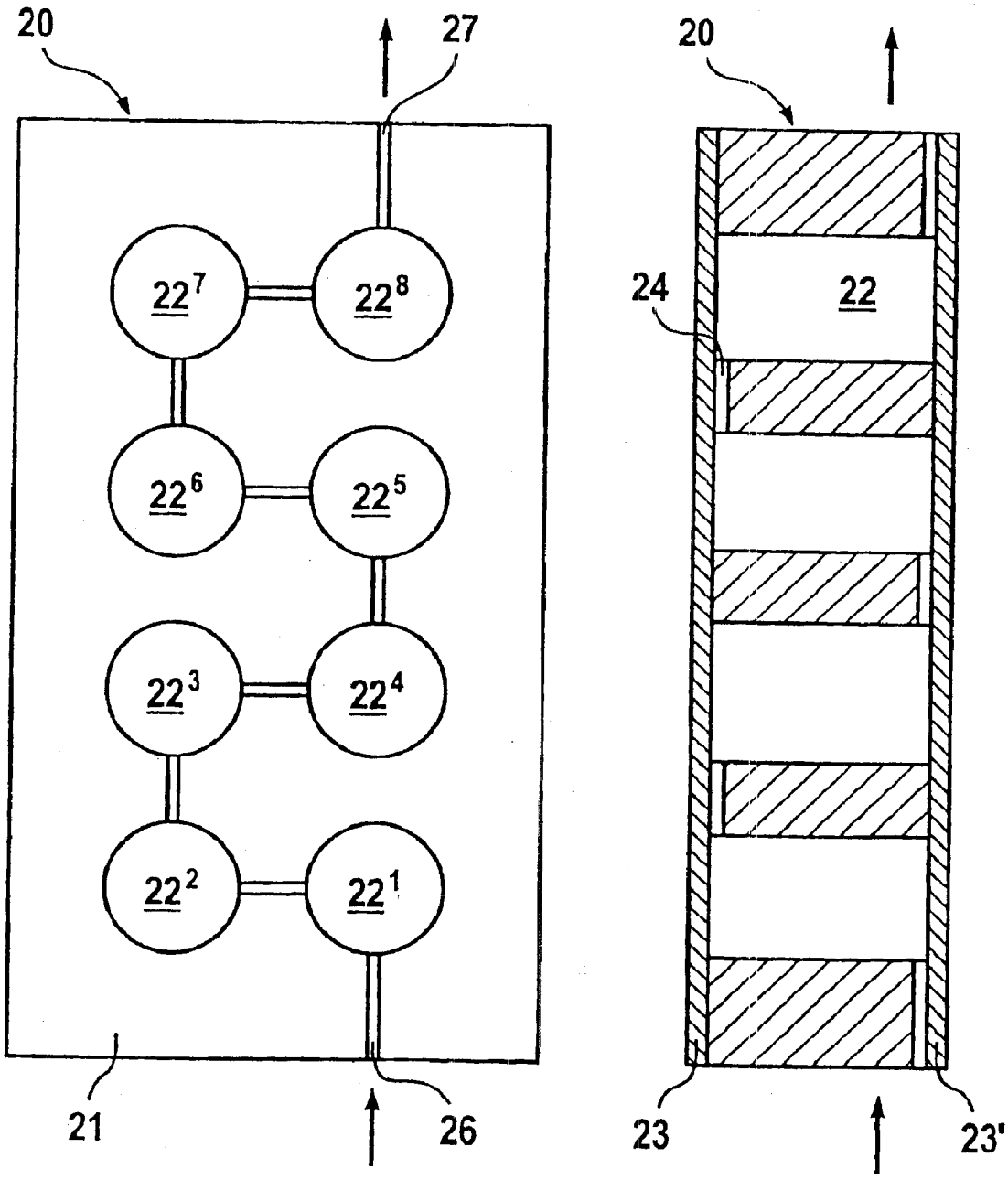
FIG. 5: Top-view and cross-section through a dilution cascade.

FIG. 5 shows a top-view and cross-section of a dilution cascade that can be used to adequately separate transport liquid from working liquid and thus prevents a change in the evaporation rate at the membrane due to components (e.g. salts) in the working fluid that cannot evaporate. The dilution cascade (20) has a base body (21) which can be for example manufactured from plastic and, in the case shown, has 8 reservoirs. The reservoirs are formed by through bores in the base body (21) which are closed by cover plates (23, 23'). The base body is also provided with microstructured channels (24) which, after the base body is covered with the cover plates, allow fluid exchange between the individual reservoirs and allow liquid to enter and be discharged from the dilution cascade.

The operating principle of the dilution cascade (20) is as follows:

The dilution cascade (20) is connected via its inlet port (26) to a fluid system in which liquid is to be transported. The dilution cascade is linked by its outlet port (27) to a pump according to the invention. When the dilution cascade is put into operation it is filled with an evaporable liquid which contains no or only very small additions of non-evaporable components. Liquid contained in the dilution cascade is now drawn out of the outlet port (27) by the action of a pump according to the invention and is followed by the liquid to be pumped which flows into the inlet port (26). The first reservoir ($22^1$) now contains a mixture of the liquid to be pumped and the dilution fluid contained in the dilution cascade. Successive dilutions take place in the subsequent reservoirs ($22^2$, $22^3$, $22^4$ . . . ) such that practically only dilution fluid without substantial amounts of the fluid to be transported emerges at the outlet port (27). In order to ensure adequate functioning of the dilution cascade, the total volume pumped by the pump should be less than half, preferably less than a quarter of the total volume of the dilution liquid in the dilution cascade.

Figure 6:
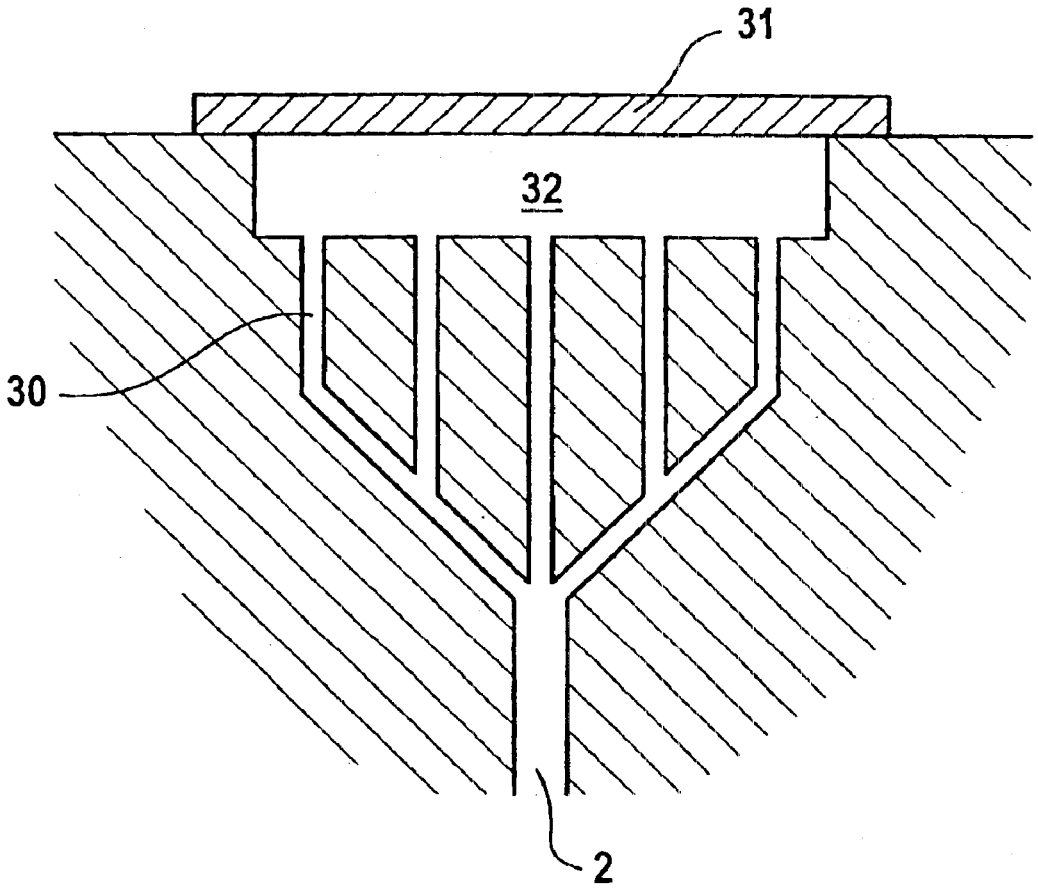
FIG. 6: Cross-section through a membrane region containing individual capillaries.

FIG. 6 shows the membrane region of a pump based on capillary channels generated by microtechnology. The fluid channel (2) branches into several capillaries (30) having a defined pore diameter and thus forms a membrane with a low number of pores. The end of a capillary can be regarded as a single pore from which evaporation into the gas phase occurs. The evaporation rate from the menisci in the capillaries can be additionally regulated by means of a non-wettable hydrophobic membrane.

FIG. 6 shows a hollow space (32) into which evaporation from the capillaries takes place. The hollow space is closed from the outer space by means of a membrane (31) in order to ensure an essentially constant vapour pressure of the fluid in the hollow space.

What is claimed is:

1. A method of producing flow rates of a transport liquid of about 1 to 1000 nl/min, the method comprising the steps of:

providing a pump comprising a housing defining a space and including a channel and a wettable membrane positioned in the housing, the membrane including a first side facing toward the channel and a second side facing the space, at least partially filling the channel with the transport liquid, contacting the wettable membrane with the transport liquid to generate an underpressure in the channel, evaporating the transport liquid at the wettable membrane to remove the transport liquid from the channel which causes a desired pump action and to create an underpressure in the channel, and maintaining a generally constant vapour pressure of the transport liquid in the space.

2. The method of claim 1 wherein the transport liquid penetrates the membrane due to capillary effects.

3. The method of claim 2 wherein the transport liquid evaporates through the membrane.

4. The method of claim 1 further comprising the step of at least partially filling the channel with a working liquid.

5. The method of claim 4 further comprising the step of segmenting the transporting and working liquids.

* * * * *